US005879149A

United States Patent [19]

Briggs et al.

[11] Patent Number: 5,879,149

[45] Date of Patent: Mar. 9, 1999

[54] FUEL CONTROL AND PREHEATING SYSTEM FOR A FUEL-BURNING HEATER

[75] Inventors: Eugene C. Briggs, Dayton, Ohio; Wayne Robertson, Nashville, Tenn.; Christopher L. Gansel, Hill City, Kans.; Gregory A. Agee, Gallatin, Tenn.

[73] Assignee: Black Gold Corporation, Nashville, Tenn.

[21] Appl. No.: 708,809

[22] Filed: Sep. 9, 1996

[51] Int. Cl.[6] ..... F23D 11/44

[52] U.S. Cl. ..... 431/208; 431/11; 431/90; 239/135; 392/397; 392/473; 392/480

[58] Field of Search ..... 431/208, 90, 11, 431/207, 258, 209, 135, 136; 239/135; 392/397, 473, 479, 480; 137/341

[56] References Cited

U.S. PATENT DOCUMENTS

| | | | |
|---|---|---|---|
| 2,859,807 | 11/1958 | Newman et al. | 431/90 |
| 3,118,490 | 1/1964 | Page-Roberts et al. | 431/208 |
| 3,300,620 | 1/1967 | Ellis | 431/208 |
| 4,354,822 | 10/1982 | Madsen et al. | 431/208 |
| 5,090,895 | 2/1992 | Jensen et al. | 431/208 |
| 5,435,718 | 7/1995 | Briggs | 431/90 |

*Primary Examiner*—James C. Yeung
*Attorney, Agent, or Firm*—Michael E. McKee

[57] ABSTRACT

A fuel control and preheating module for use with an oil-burning furnace including a fuel line providing a passageway section through which oil is routed from a reservoir to the furnace for burning includes an electrically-powered positive temperature coefficient (PTC) heating element mounted in heat transfer relationship with oil contained with the passageway section. During the operation of the PTC element, the PTC element heats the oil contained within the passageway section to a preselected temperature and maintains the oil contained within the passageway section at the preselected temperature. Also associated with the module is a movable diaphragm and shutoff plate which is responsive to the internal pressure changes in the air passageway of the furnace upon shutdown and start-up of the furnace to withdraw oil from and shut off delivery of oil to the nozzle upon furnace shutdown and to push oil toward the nozzle upon start-up of the furnace.

20 Claims, 6 Drawing Sheets

FUEL CONTROL AND PREHEATING SYSTEM FOR A FUEL-BURNING HEATER

BACKGROUND OF THE INVENTION

This invention relates generally to furnaces which utilize fuel oil or waste oil as fuel and relates, more particularly, to the means by which fuel is preheated prior to its introduction into the combustion zone of such a furnace for burning.

Prior art furnaces which burn fuel oil or waste oil in a combustion zone commonly include a nozzle block assembly utilizing an atomizing nozzle through which air and oil are conducted into the combustion zone for burning and a fuel pump and air compressor for delivering fuel and air, respectively, to the nozzle. It is desirable in some instances that the oil is preheated prior to its introduction into the combustion zone, and for purposes of preheating the oil, known schemes exist. For example, in U.S. Pat. No. 5,372,484 having the same assignee as the instant invention, a nozzle block assembly is described wherein an electrical resistance heater is supported within the nozzle block for heating the nozzle block (primarily by radiant heat emitted from the element) and air routed through the block. The heated nozzle block, in turn, heats the oil routed therethrough. Thermostats mounted within the block monitor the block temperature and prevent operation of the oil pump unless the temperature of the nozzle block is within a preselected temperature range.

Another preheating scheme, such as is described in U.S. Pat. No. 4,487,571 having inventors in common with the instant invention, involves the mounting of a positive temperature coefficient (PTC) thermistor on one side of the nozzle block. The oil contained within the fuel passageway provided within the nozzle block is heated by the transfer of heat from the PTC thermistor through the body of the nozzle block.

It is known that if the oil is preheated to an unacceptably high level, the oil may carbonize (or burn partially) prior to its introduction into the combustion zone of such a furnace and thereby reduce the effectiveness of the oil for heating purposes. Along the same lines, if the oil is heated through a surface (e.g. a metal surface) which is much hotter than the temperature to which the oil is desired to be heated, the oil may carbonize and an undesirable build up of carbon will collect upon the surface, and the carbonized oil and carbon build up can adversely effect furnace operation. On the other hand, if the oil is not heated to a high enough temperature prior to its introduction into the combustion zone, the oil is likely not to burn completely within the combustion zone thereby wasting energy and producing pollution from unburned hydrocarbons.

It would be desirable to provide an improved oil preheating scheme for an oil-burning furnace of the aforedescribed class which is less likely to overheat, and thereby carbonize, oil prior to its introduction into the combustion zone of the furnace.

Accordingly, it is an object of the present invention to provide a new and improved system for preheating fuel prior to its introduction into the combustion zone of a furnace of this class while controlling the power consumption of the preheating system for preheating the fuel.

Another object of the present invention is to provide such a system which is effective in operation, is safer in some respects, and is less likely to overheat oil than are preheating schemes of the prior art. draws power on an as-needed basis to maintain the oil at the desired temperature.

In another aspect of the invention, the improvement comprises shutoff means associated with the fuel passageway disposed upstream of the nozzle block assembly and responsive to the internal pressure of the air passageway for shutting off the flow of oil along the fuel line upon shutdown of furnace operation.

DETAILED DESCRIPTION OF THE ILLUSTRATED EMBODIMENTS

Figure 1:
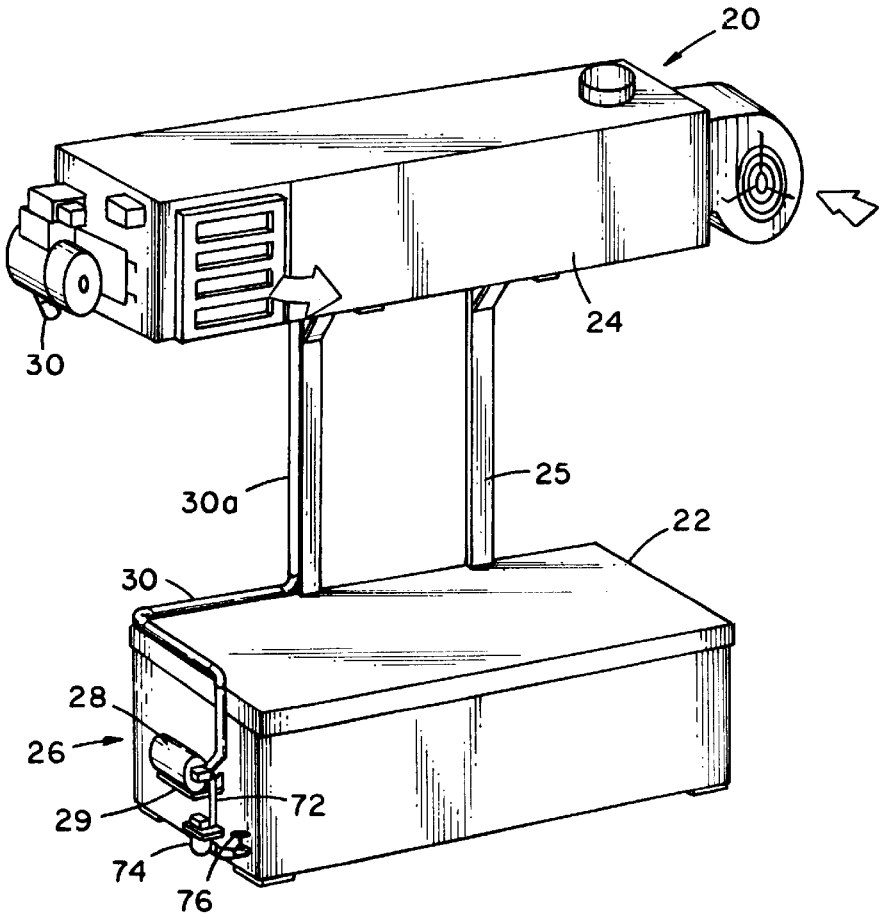
FIG. 1 is a perspective view of a waste oil-burning heating system within which features of the present invention are incorporated.

Turning now to the drawings in greater detail there is illustrated in FIG. 1 a heating system 20 including an oil-burning furnace 24 within which waste oil is burned and a reservoir tank 22 within which oil is stored until burned in the furnace 24. The furnace 24 is supported in an elevated condition above the reservoir 22 by means of a stand 25. The system 20 also includes a fuel delivery system, generally indicated 26, including a pump assembly 28 having a metering pump 29 disposed adjacent the reservoir 22 and the furnace 24. During operation of the heating system 20, oil is pumped through the fuel line 30 by the pump assembly 28 from the reservoir 22 to the furnace 24 at a metered, substantially constant flow rate. It is a feature of the furnace that it includes means, generally indicated 18 in FIG. 3, associated with the fuel line 30 for preheating the oil prior to burning. Furthermore, upon shutdown of furnace operation, additional means, described.

Still another object of the present invention is to provide such a system which requires less power during furnace operation and is efficient and reliable in operation.

Yet another object of the present invention is to provide such a system which integrates a purging function and a shutoff function with a low watt per square inch preheating function.

A further object of the present invention is to provide such a system which is embodied in a modular unit for use within the fuel line disposed upstream of the nozzle block so that a nozzle block of lower cost can be utilized within the furnace.

SUMMARY OF THE INVENTION

This invention resides in a fuel preheating system for an oil-burning furnace having a combustion zone within which oil is burned in the presence of air, a nozzle block assembly including an atomizing nozzle through which oil is routed into the combustion zone for burning, and a fuel line providing a passageway disposed upstream of the nozzle block and through which oil is routed to the nozzle block assembly.

The improvement comprises an electrically-powered positive temperature coefficient (PTC) heating element for receiving power from a source. The PTC heating element is mounted in heat transfer relationship with oil contained within the passageway disposed upstream of the nozzle block assembly for heating the oil contained therein to about a preselected temperature.

The power (i.e. current) draw of a PTC heating element decreases as the temperature of the element approaches a preselected temperature. Thus, by utilizing a PTC element whose power requirements drop to near-zero upon reaching a temperature to which the oil is desired to be preheated, the PTC element herein, associated with the preheating means 18 purge oil from a lengthy section of the fuel line.

Figure 2:
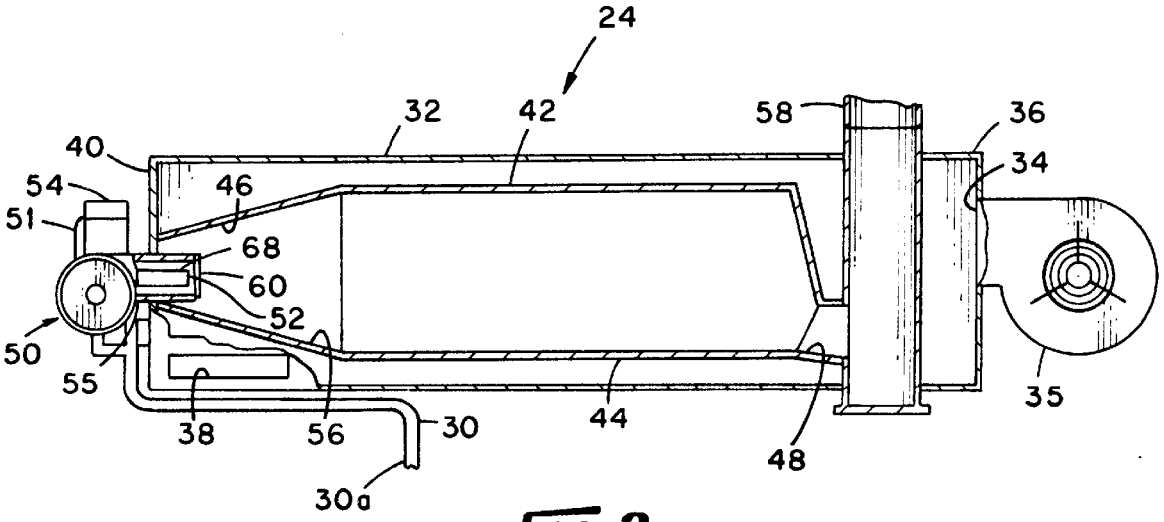
FIG. 2 is an elevational view, shown partially in section, of the furnace of the FIG. 1 system.

As best shown in FIG. 2, the furnace 24 includes an elongated housing 32 having an air intake 34 adjacent one end of the housing 32 and a discharge vent 38 adjacent the other end of the housing 32, a circulating air blower 35 supported adjacent the air intake end 36 of the housing 32 and a heat exchanger 42 having an elongated hollow body 44 supported axially along the housing 32. The heat exchanger body 44 includes an inlet end 46 through which oil and air are introduced into the heat exchanger body 44 for burning and an opposite outlet end 48. The furnace 24 also includes a burner assembly 50 supported by the housing 32 adjacent the vent end 40 for burning the oil within the heat exchanger 42 and an oil burner blower 51 for moving the products of combustion from the inlet end 46 of the heat exchanger body 44 toward the outlet end 48. The burner assembly 50 also includes an atomizing nozzle 52 for directing oil and compressed air into the heat exchanger body 44 and an air compressor 54 for delivering compressed air to the nozzle 52. An ignition transformer including electrodes 55 is supported adjacent the nozzle 52 for igniting the burner, and a flame retention head 60 is supported forwardly of the nozzle 52 for maintaining the flame of the burner adjacent the nozzle 52.

During use of the furnace 24, the oil which is introduced within the heat exchanger body 44 through the nozzle 52 is burned within a combustion zone 56 provided by the heat exchanger 42 so that the outer surface of the heat exchanger 42 is heated by the flame and attending combustion products moving through the heat exchanger body 42. The products of combustion are subsequently forced out of the heat exchanger 42 by way of a flue discharge conduit 58 connected to the outlet end 48 of the heat exchanger body 44. Air, such as room air, desired to be heated by the furnace 24 is forced by the circulating blower 35 into the housing 32 through the intake end 36 so that the air flows between the outer surface of the heat exchanger 42 and the walls of the housing 32. As air is moved around the heat exchanger 42, it absorbs heat therefrom and subsequently exits the housing 32 through the discharge vent 38 in a heated condition. For a more detailed description of the structure and operation of the primary components of the furnace 24, reference can be had to U.S. Pat. No. 4,955,359, the disclosure of which is incorporated herein by reference.

Figure 3:
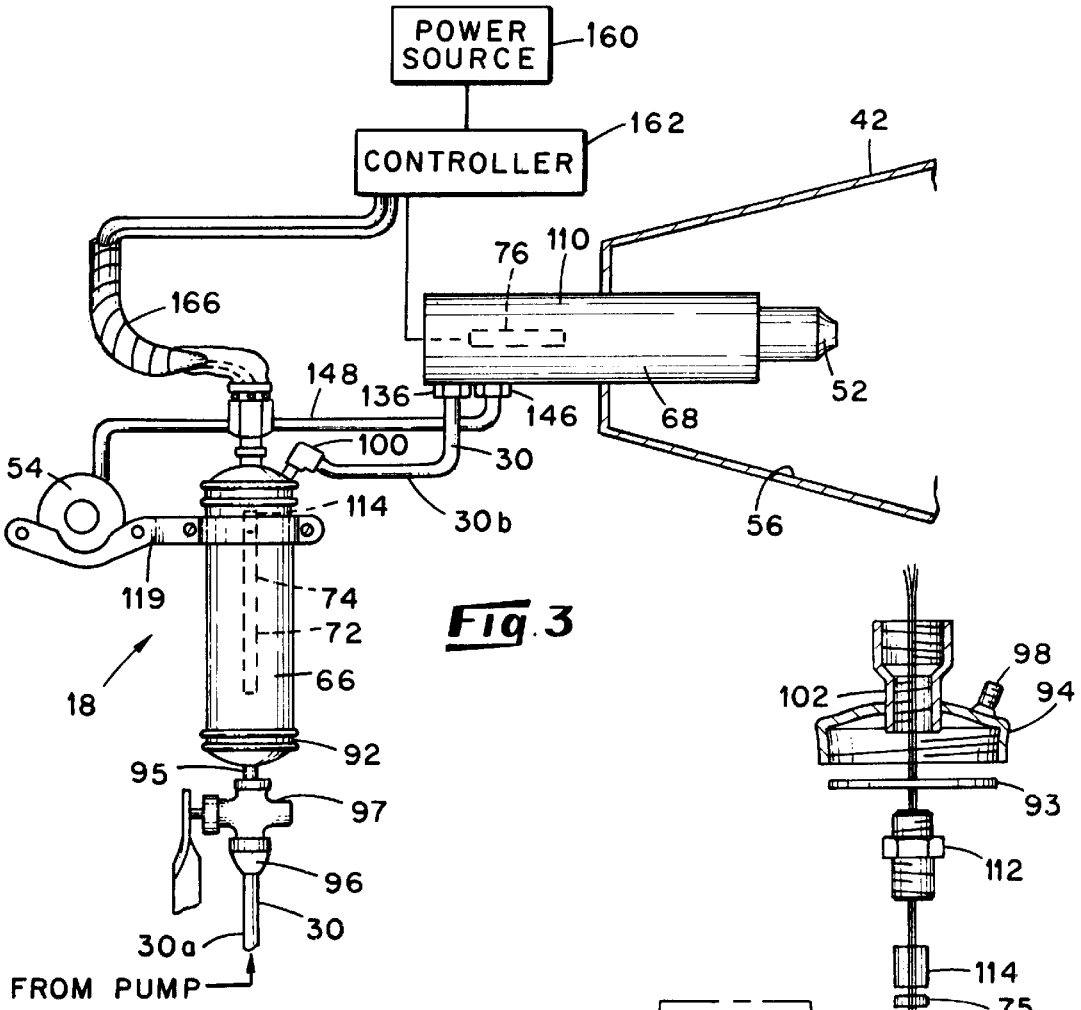
FIG. 3 is a fragmentary view illustrating schematically the nozzle block and oil pre-heating apparatus of the FIG. 1 furnace.

As oil is pumped from the reservoir 22 to the combustion zone 56 for burning and with reference to FIGS. 1 and 3, the oil moves in sequence through the pump assembly 28, through a lengthy section, indicated 30*a*, of the fuel line 30, and then through the preheating system 18 before entering the combustion zone 56 by way of the atomizing nozzle 52. In the depicted embodiment, the system 18 includes a modular preheating unit 66 and a nozzle block assembly 68 within which the nozzle 52 is mounted. As best shown in FIG. 3, the preheating unit 66 and nozzle block assembly 68 are joined by a short section, indicated 30*b*, of the fuel line 30. The metering pump 29 of the pump assembly 68 pushes the oil along a generally upward path to the elevated components of the furnace 24 and includes a check valve (not shown) for preventing the return of the oil from the furnace 24 to the reservoir 22 upon shutdown of the pump 29. Therefore, between cycles of furnace operation (during which the pump 29 is de-energized), the pump check valve prevents oil from draining downwardly out of the preheating unit 66 and the nozzle block assembly 68. Thus, the check valve ensures that oil is always contained within the unit 66 and nozzle block assembly 68 and thereby in a condition for being preheated to a desired temperature for use during a subsequent cycle of furnace operation.

It is a feature of the heating system 20 that its oil-preheating system 18 includes a positive temperature coefficient (PTC) electric heating element adapted to receive operating power from an electrical power source for preheating oil prior to its introduction into the combustion zone 56 by way of the nozzle 52. As will be apparent herein, the preheating system 18 preheats the oil as well as controls the electrical power consumption used for the purpose of preheating the oil. In the depicted preheating system 18 (FIG. 3), three PTC elements 72, 74, 76 are utilized wherein two PTC elements 72, 74 are mounted in the preheating unit 66 and the remaining PTC element 76 is associated with the nozzle block assembly 68. As exemplified by the PTC element 72 in FIG. 4, each PTC element 72, 74 or 76 includes an element pellet (e.g. pellet 78) and lead wires (e.g. wires 80) through which electric power is conducted to the element body 78 from a source. Each element pellet is constructed of a doped polycrystalline ceramic material, hence is commonly referred to as a "ceramic heater".

It will be understood that although the PCT elements of the depicted system 18 are described as having pellets of a doped ceramic material, there exists resistance cartridge wire heaters that exhibit the same positive temperature coefficient characteristics as the ceramic elements used in the system 18. Such cartridge wire heaters may include nickel, iron or chromium which experiences a dramatic increase in resistance in response to a temperature rise, and may be preferred, in some applications, over ceramic elements due to the ruggedness of the wire heaters. Accordingly, in the interests of the present invention, the term "PTC heating element" will be understood as including resistence cartridge wire heaters, as well as ceramic PTC heating elements.

Positive temperature coefficient (PTC) heating elements are characterized in that they possess an extreme temperature coefficient over a very narrow range of temperatures. The result of this extreme PTC attribute is a heating element which self-regulates at a preset temperature (i.e. its curie point temperature as it regards the ceramic PTC elements) and varies its wattage demands automatically in order to maintain that preset temperature. In other words, as a PTC element receives electrical power from a source and its temperature approaches a preset temperature, the power requirement (i.e. the current draw) of the element decreases so that upon reaching the preset temperature, the power drawn by the element is near-zero so that the element is effectively shut OFF. When the temperature of the element subsequently drops below the preset temperature, the element again withdraws power from the source until its temperature returns to the preset temperature. In practice, the cooler the oil required to be heated by the PTC element, the greater the amount of heat which is drawn from the PTC element. Thus, the PTC element automatically and economically maintains its preset temperature without the need for temperature controlling thermostats.

Figure 4:
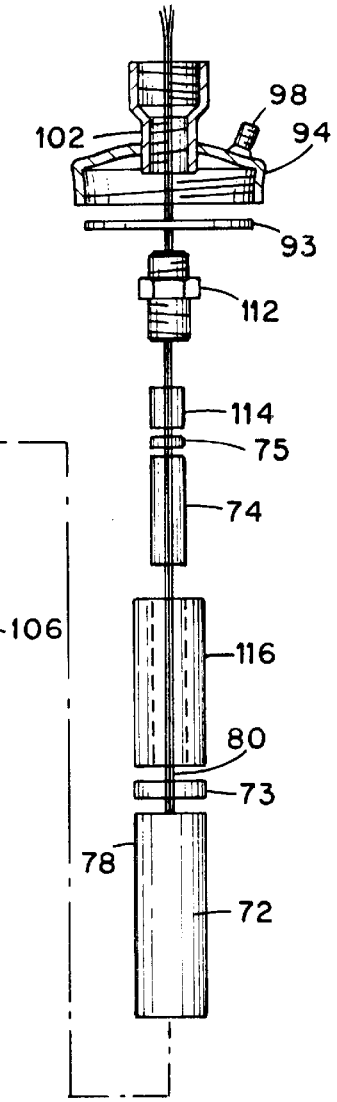
FIG. 4 is an elevational view, shown partially in longitudinal section, of the oil-preheating apparatus of FIG. 3, shown exploded.
Figure 4:
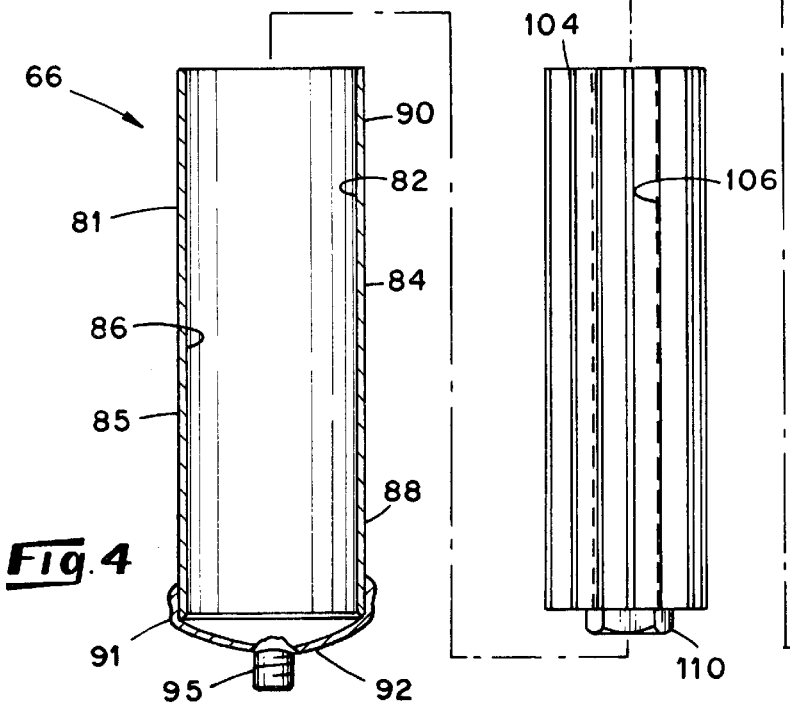

As best shown in FIG. 4, the preheating unit 66 of the preheating system 18 includes a body 81 having an internal cavity 82 through which oil is pumped toward the nozzle 52. In the depicted embodiment, the body 81 of the preheating unit 66 includes a canister 84 having a tubular shell 85 having an interior 86 and two opposite ends 88, 90. The ends 88, 90 of the canister 84 are capped with a pair of lower and upper end caps 92 and 94, and gaskets 91 and 93 are sandwiched between each shell end 88 or 90 and its corresponding end cap 92 or 94. One end cap 92 includes a centrally-located nipple 95 for attachment to the fuel line section 30*a* by way of a shut-off valve 96 (FIG. 3) and a fitting 96, and the other end cap 94 includes a peripherally-located nipple 98 for attachment to the (shorter) fuel line section 30*b* by way of a fitting 100 and also includes a central opening 102 whose purpose will become apparent herein. Thus, oil which is pumped from the reservoir 22 toward the nozzle 52 enters the canister 84 by way of the nipple 95 provided in the lower cap 92 and exits the canister 84 by way of the nipple 98 provided in the upper cap 94.

Figure 5:
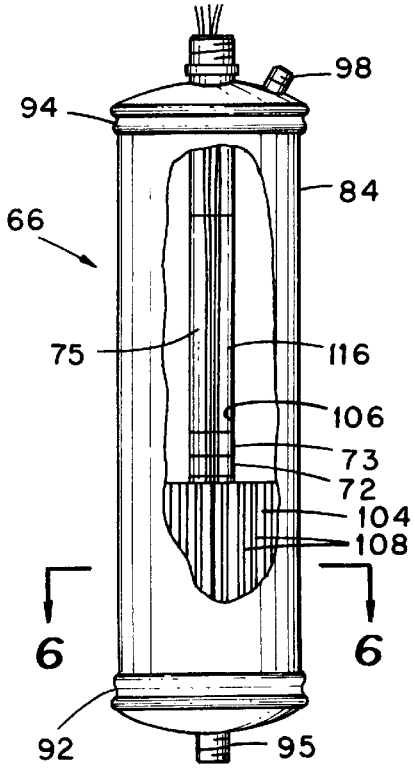
FIG. 5 is a view similar to that of FIG. 4 illustrating the oil-preheating apparatus, but shown assembled and partially cut-away.
Figure 6:
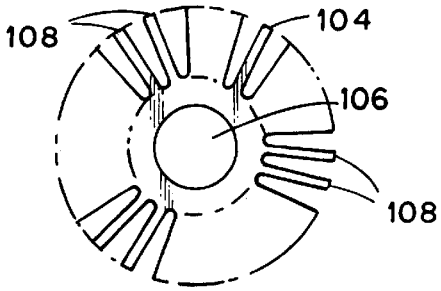
FIG. 6 is a cross-sectional view of the finned sheath of the oil-preheating apparatus taken about along line 6—6 of FIG. 5.

With reference to FIGS. 4 and 5, there is mounted within the canister 84 a finned sheath 104 which extends between the ends 88, 90 of the canister shell 85. The sheath 104 is shaped so as to provide a central through-opening 106 extending longitudinally therethrough and a plurality of fins 108 which extend radially of the longitudinal axis of the sheath 104. Preferably, the sheath 104 is constructed of a material of relative high conductivity, such as aluminum, and is formed, for example, in an extrusion process. The open ends of the central opening 106 of the sheath 106 are suitably plugged with plugs 110 and 112, as shown in FIG. 4. As the oil flows into the lower end of the unit 66 through the nipple 95 and exits the upper end of the unit 66 through the nipple 98 during furnace operation, the sheath 104 and canister 84 confine the oil between the exterior surfaces of the fins 108 and the interior walls of the canister shell 85. Thus, as the oil flows along the length of the unit 66, the oil flows along the length of the sheath fins 108.

Preferably, the amount of heat transfer area provided by the surface of the fins 108 is sufficient to maintain the ratio of watts per square inch near 1.0. Such a ratio ensures that the temperature of the surface of the (metal) fins does not have to significantly exceed the desired temperature of the oil, thereby minimizing the likelihood of carbonization while ensuring that sufficient heat is transferred to the oil. In the depicted embodiment, the sheath 108 provides about 120 square inches of fin surface through which heat is conducted into the oil.

Figure 7:
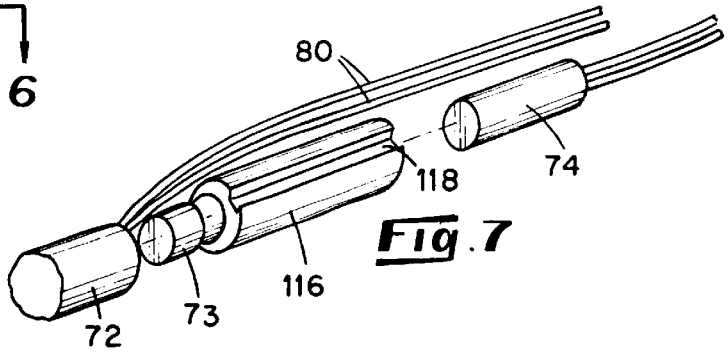
FIG. 7 is a fragmentary perspective view of selected internal components of the oil-preheating apparatus of FIGS. 4 and 5.

The preheating unit 66 further includes the pair of positive temperature coefficient (PTC) electric heating elements 72, 74, introduced earlier, and a normally-open thermostat 114 which is wired in series with a room thermostat 115. Each of the PTC elements 72, 74 and the thermostat 114 is positioned within the central through-opening 106 so as to be in good heat exchange relationship with the walls of the central opening 106, yet are insulated from one another by plugs 73, 75 comprised, for example, of silicone rubber. To this end, the outer diameter of the cylindrical element pellet of the PTC element 72 is about equal to that of the central opening 106 and is press-fitted therein. Similarly, the other PTC element 74 is press-fitted within a metallic sleeve 116 which, in turn, is press-fitted within the central opening 106 atop the PTC element 72. As best shown in FIG. 7, a groove 118 is formed along the outside surface of the sleeve 116 and provides a guideway along which the lead wires 80 of the PTC element 72 are routed around the element 74 and toward the end cap 94.

Within the central opening 106 of the sheath 104, the PTC element 72 is positioned adjacent the lower end, as viewed in FIG. 4, of the sheath 104, the PTC element 74 is positioned about midway between the ends of the sheath 104, and the thermostat 114 is positioned adjacent the upper end of the sheath 104. The lead wires of the PTC elements 72 and 74 are routed from the corresponding element pellet and out of the canister 84 by way of the opening 102 provided in the end cap 94 for connection to a power source 160 by way of a controller 162.

The thermostat 114 is also fitted within the sleeve 116 for accurately sensing the temperature of the inside wall of the sheath 104 through the body of the sleeve 116. The lead wires of the thermostat 114 are routed out of the canister 84 by way of the opening 102 provided in the end cap 94 to the controller 162 (FIG. 3) and are routed to the controller 162 through a suitable conduit 166.

Within the furnace 24, the preheating unit 66 is mounted in a substantially vertical orientation as depicted in FIG. 3. In addition, a bracket 119 tightly encircles the canister shell 85 and is attached to the mount of the air compressor 54 to support the unit 66 adjacent the nozzle block assembly 68. It is a feature of the furnace 24 that the preheating unit 66 is mounted in relatively close proximity (e.g. within two to three inches) of the nozzle block assembly 68 to reduce the distance that oil is required to travel from the unit 66 to the nozzle block assembly 68. Along these lines, the short section 30*b* of the fuel line 30 is about 3.0 inches in length.

Within the depicted embodiment, the PTC element 72 is adapted to heat to a predetermined temperature, and the PTC element 74 is adapted to heat to another predetermined temperature. Each PTC element 72 or 74 has been sized and its preset temperature has been chosen through a testing process so that each element 72 or 74 heats oil contained within (or flowing through) the canister 84 by an amount sufficient for the application. One PTC element 74 operates as a "stand-by" heating element in that electrical power is continually available to the element 74 for operation, even between operating cycles of the furnace 24. Thus, prior to an operating cycle of the furnace 24, the PTC element 74 preheats oil contained within the canister 84 to a preset, or desired, temperature corresponding to the predetermined setting of the PTC element 74 and maintains the canister oil at that preset temperature as the element 74 draws power from the source 160 on an as-needed basis. During an operating cycle of the furnace 24, the PTC element 74 continues to draw power from the source 160 as needed for contributing to the heating of the oil which flows through the canister 84 toward the nozzle 52.

The other PTC element 72 operates as a "run" heating element in that it is permitted to withdraw power from the source 160 (FIG. 10) only during an operating cycle of the furnace 24. Since oil is pumped through the canister 84 by way of the pump assembly 28 too rapidly to be heated by the "stand-by" element 74 to a desired temperature, the PTC element 72, with its higher preset temperature, acts in concert with the PTC element 74 to heat the oil flowing through the canister 84. Power is prevented from being withdrawn by the PTC element 72 between cycles of furnace operation by appropriate controls mounted in the controller 162. It has been found that between operating cycles of the furnace 24, the oil is satisfactorily heated and maintained in a preheated condition in the canister 84 by the PTC element 74 without overheating, and that during operating cycles of the furnace 24, the oil (which moves through the unit 66 at about 1.4 gallons per hour) is satisfactorily heated to between about 150° F. and 170° F. by the collective contributions of both the PTC elements 72 and 74 (which provides a desired Btu flow rate).

The thermostat 114 is normally-open, as mentioned above, and is adapted to close upon sensing of a rise in temperature of the sheath 104 to, for example, about 130° F. (which temperature is mentioned for purposes of illustration and not as limitation). Moreover, the thermostat 114 is appropriately wired to the controller 162 to prevent the initiation of an operating cycle of the furnace 24 until the canister oil, or more specifically, the interior of the canister sheath 104, reaches a desired temperature of about 130° F. Therefore, upon energizing the furnace 24, through, for example, a room thermostat, the thermostat 114 prevents the pump assembly 28 and the ignition transformer, as well as the air compressor 54 and burner blower 51, from operating until the temperature of the sheath 104 reaches about 130° F. If the sheath 104 is in a preheated condition (e.g. at the temperature of at least about 130° F.) by operation of the PTC "stand-by" element 74 (which is always under power from the source 160) or when the sheath 104 attains the desired minimum temperature of about 130° F., the thermostat 114 closes and the pump assembly 28, burner blower 51 and air compressor 54 are switched ON. The thermostat 114 thus ensures that oil contained within the canister 84 attains a desired temperature before a cycle of furnace operation is initiated.

It follows from the foregoing that following a power failure (which temporarily shuts off power from the source 160), the thermostat 114 prevents the initiation of a cycle of furnace operation until the temperature of the oil within the canister 84 reaches (or returns to) the desired temperature of about 130° F. In other words, the recovery of power following a power failure will automatically re-initiate operation of the "stand-by" PTC element 74, and the thermostat 114 will prevent the initiation of a subsequent cycle of furnace operation until the temperature of oil within the canister 84 is elevated to the desired temperature of about 130° F.

Features of the aforedescribed oil preheating unit 66 which help render the PTC units 72 and 74 effective as oil-preheating devices in this application include the provision of the relatively large fin-to-oil heat transfer area provided by the fins of the sheath 108. Because the depicted sheath 108 provides such a large heat transfer area over which the heat generated by the PTC elements 72 and 74 is transferred to the oil, the heat transferred to the oil per unit area of fin surface is relatively low (i.e. less than about 1.0 watts per square inch of the fin area), and this feature reduces the likelihood that hot spots will develop within the unit 66 at which oil is likely to carbonize. In other words, by distributing the heat generated by the PTC elements to the oil over such a large heat transfer area, the maximum temperature differential achieved between the oil contained within the canister 84 and the interior of the sheath 108 within which the PTC units 72, 74 are supported is relatively low, thereby further reducing the likelihood of oil carbonization within the unit 66.

In addition, the nature and operation of each PTC unit of the system 18 which provides self-regulation (as such self-regulation relates to its power requirements and its preset, or curie point, temperature) is quite different from other temperature-regulating devices, such as snap-disc thermostats, which rely upon movement of a switch upon reaching a predetermined temperature to switch electrical power from full ON to OFF, and vice-versa. As a practical matter, it is difficult with such temperature-regulating devices not to occasionally overshoot a predetermined, or target, temperature and carbonize the oil. In addition, the regulating devices which rely on a movable switch may fail and not be able to prevent the oil of a preheating unit from reaching undesirably-high temperatures. Consequently, the PTC units of the system 18 are more reliable as components for preventing carbonization of oil in oil preheating systems and, in this sense, are safer than are other temperature-regulating devices.

Another feature of the preheating unit 66 relates to the end-to-end (or stacked) relationship of the PTC units 72 and 74 within the central opening 106 of the sheath 108. By arranging the PTC units 72 and 74 in this manner, each PTC unit 72 and 74 is positioned substantially centrally within the sheath 108 for heating oil flowing thereabout and each PTC unit 72 and 74 is able to take advantage of the large fin-to-oil heat transfer area provided by the sheath 108. The aforedescribed groove 118 (FIG. 5) provided along the PTC-accepting sleeve 116 accommodates this end-to-end arrangement of the PTC units 72, 74 in that it permits the wires of both PTC units to be routed out of the same end of the sheath 108 without mashing the wires between the wall of the central opening 106 and either of the PTC units, and the groove 118 is advantageous in this respect.

Figure 8:
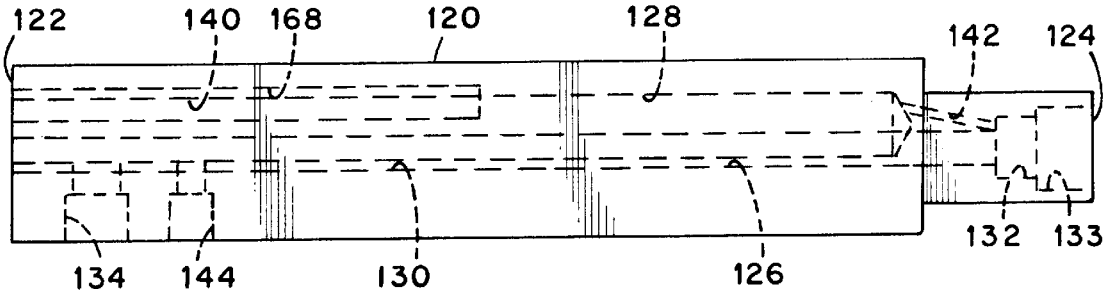
FIG. 8 is a side elevational view of the block of the nozzle assembly of FIG. 3.
Figure 9:
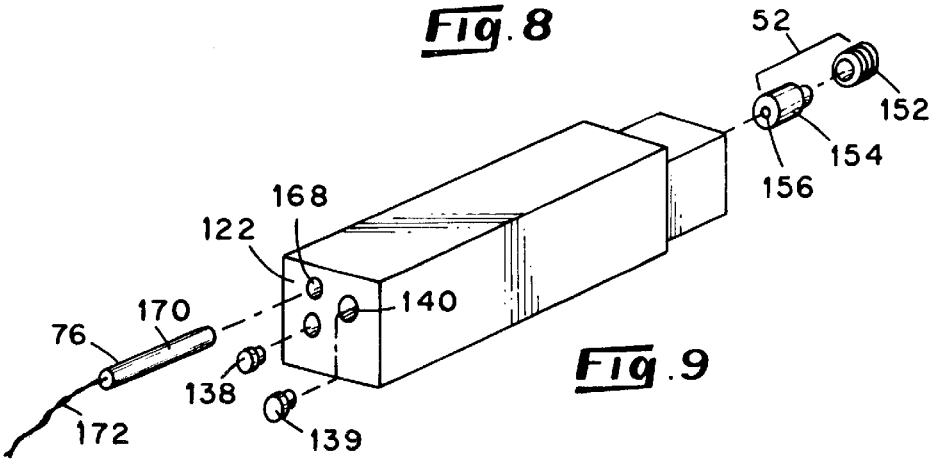
FIG. 9 is a perspective view of the nozzle assembly of FIG. 3, shown exploded.

With reference to FIGS. 8 and 9, the furnace nozzle 52 is one component of the nozzle block assembly 68 supported adjacent the combustion zone 56 of the furnace 24. The nozzle block assembly 68 of the depicted furnace 24 includes a body, or block 120, constructed of aluminum or other suitable material within which the nozzle 52 is mounted and through which oil and air from the pump assembly 28 and compressor 54, respectively, are routed to the nozzle 52. As best shown in FIG. 8, the block 120 includes two opposite ends 122 and 124 and an oil passageway 126 and an air passageway 128. The oil passageway 126 is provided, in part, by a bore 130 extending substantially centrally through the block 120 from the block end 122 to a location adjacent the opposite block end 124. At the opposite end 124, an enlarged bore section 132 communicates with the central bore section 130 and is internally-threaded at the bore entrance adjacent the block end 124. The remainder of the oil passageway 126 is provided by an access bore 134 having an internally-threaded section for threadably receiving a fitting 136 (FIG. 3) for joining the short section 30*b* of the fuel line 30 to the nozzle block 110. The entrance of the central bore 130 adjacent the block end 122 is closed by a plug 138 (FIG. 9) secured therein.

With reference again to FIG. 8, the air passageway 128 of the block 120 is provided, in part, by a longitudinal bore 140 extending from the block end 122 to a location adjacent the opposite block end 124 and a smaller bore 142 providing communication between the bore 140 and the enlarged bore section 132. An access bore 144 is formed in one side of the block 120 so as to communicate with the longitudinal bore 140, and the entrance of the access bore 144 is provided with an internally-threaded section for threadably receiving a fitting 146 (FIG. 3) used for joining the air conduit, indicated 148 in FIG. 3, leading from the air compressor 54 to the nozzle block 120. The end of the bore 140 adjacent the block end 122 is closed by a plug 139 (FIG. 9) secured therein.

As best shown in FIG. 9, the nozzle 52 is a multipieced unit having a securement member 152 for threadably securing the nozzle 52 within the entrance, indicated 133 in FIG. 8, of the bore section 132 of the block 120 and a central member 154 retainably positioned within the bore section entrance 133 by the securement member 152 and which includes a central through-opening 156. When the nozzle 52 is secured within the block 120 and the furnace 24 is in operation, the oil flowing through the oil passageway 126 (FIG. 8) exits the nozzle 52 through the through-opening 156, and air flowing through the air passageway 128 (FIG. 8) enters the enlarged bore section 132 and exits the nozzle 52 through suitable passageways provided about the through-opening 156 of the central member 156.

The nozzle block 120 also includes a longitudinal bore 168 which extends into the block 120 from the end 122 thereof and the PTC electric heating element 150, introduced earlier, is positioned within the longitudinal bore 168. To enhance the ability to conduct heat from the pellet, indicated 170, of the PTC element 76 to the body of the block 120, the PTC element 76 is closely positioned (as in a press-fitted relationship) within the bore 168. As best shown in FIG. 9, the PTC element pellet 170 extends for a substantial distance along the length of the bore 168 and the element power wires, indicated 172 in FIG. 9, extend from the element pellet 170 out through the entrance of the longitudinal bore 168 to the power source 160 (FIG. 3) by way of the controller 162. The entrance of the bore 168 is sealed about the power wires 172 with a suitable sealant, such as a silicone rubber adhesive. The power wires 172 of the PTC element 76 are wired within the controller 162 so that power from the source 160 is continually available to the element 76. Thus, as is the case with the PTC element 74 of the unit 66, the PTC element 76 operates as a "stand-by" heating unit for preheating oil contained within the block 120 to a desired temperature of, for example, about 170° F. between cycles of furnace operation and helps to heat the oil flowing through the block 120 toward the nozzle 52 during cycles of furnace operation. As was the case with the PTC elements 72, 74 of the preheating unit 66, the PTC element 76 is sized and its preset temperature is selected through a testing process so that the element 76 heats oil contained within (or flowing through) the nozzle block body 120 by an amount sufficient for the application. It will be understood that the PTC element 76, as well as the PTC elements 72 and 74 of the preheating unit 66, heat oil as heat is conducted from the element pellet through the body of the block body 120 (or sheath 114). To at least a limited extent, the heated condition of the block 120 heats air which is contained and moves through the air passageway 128 of the block.

Figure 10:
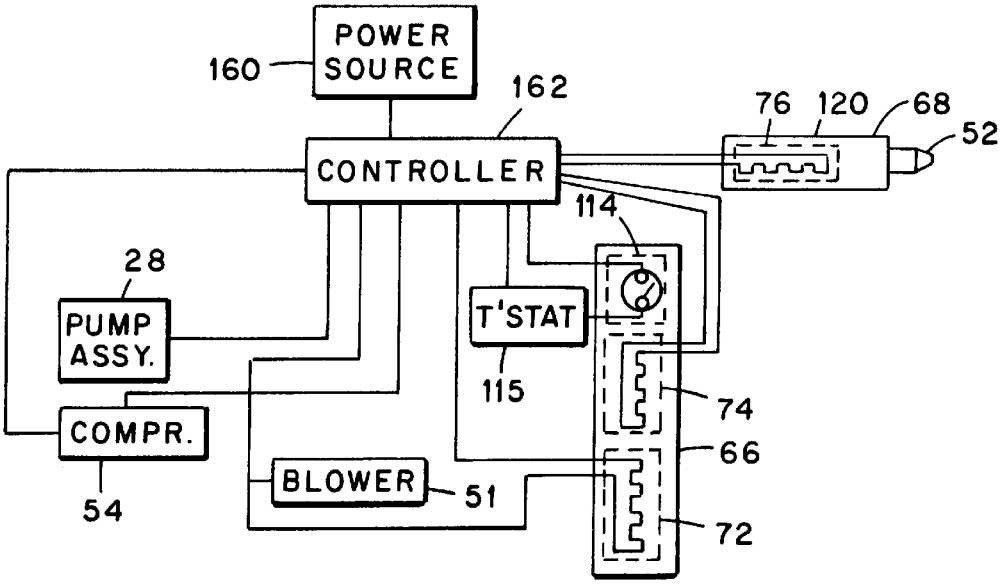
FIG. 10 is a schematic view illustrating in block diagram form the wiring of the FIG. 1 heater system.

The operation of the furnace 24 and its preheating system 18 can be summarized as follows with reference to FIG. 10. As long as power is available from the source 160, the PTC element 74 of the preheating unit 66 and the PTC element 76 of the nozzle block assembly 68 are permitted to withdraw power from the source 160 on an as-needed basis for heating oil contained within the canister 84 and nozzle block 120 to a preselected temperature and for maintaining the oil at the preselected temperature. Therefore, prior to the initiation of a cycle of furnace operation, the oil contained within the canister 84 and nozzle block 120 is maintained by the PTC elements 74 and 76 in a preheated condition and the unit thermostat 114 is closed in response to the preheated condition of the oil within the unit 66. Upon subsequent energizing of the furnace 24, through for example, the room thermostat 115, the pump 29 of the pump assembly 28, the air compressor 54 and the burner blower 51 are switched ON and the burn is ignited within the combustion zone 56. In addition, upon energizing of the pump assembly 28 (which initiates flow through the canister 84), power is permitted to be withdrawn by the "run" PTC element 72 of the unit 66 so that the element 72 is permitted to help heat the oil moving through the canister 84. Upon termination of a furnace operating cycle, power to the "run" PTC element 72 and pump assembly 28 is turned OFF.

It follows from the foregoing that an oil-burning furnace 24 has been described which utilizes a preheating system 18 for preheating oil whether the furnace 24 is in a stand-by mode or in a cycle of operation. In particular, a preheating unit 66 has been described which includes a "stand-by" PTC heating element 74 for heating oil contained therein during and between operating cycles of furnace operation and a "run" PTC heating element 72 which contributes to the heating of the oil during the operating cycles of the furnace 24. In addition, a nozzle block assembly 68 has been described which includes a "stand-by" PTC heating element 74 for heating oil contained therein during and between operating cycles of furnace operation. The aforedescribed PTC elements 72, 74, 76 are advantageous in that they provide uniform temperature control, are self-regulating (and thereby efficiently operated), and do not require thermostats (which may otherwise be numerous or stationed at remote external locations) to prevent overheating and carbonization of the oil.

The vertical orientation of the preheating unit 66 and the arrangement of the PTC heating elements 72, 74 therein are also advantageous in that between cycles of furnace operation, the hottest oil contained within the canister 84 is moved by natural convection toward the upper end of the canister 84. This effectively positions the hottest oil in a condition to be the first amount of oil to be delivered to the nozzle 52 during furnace operation. The large surface area of the finned sheath 104 provides an additional advantage in that it prevents the formation of hot spots which may otherwise deposit gum and varnish caused by fuel overheating.

Figure 11:
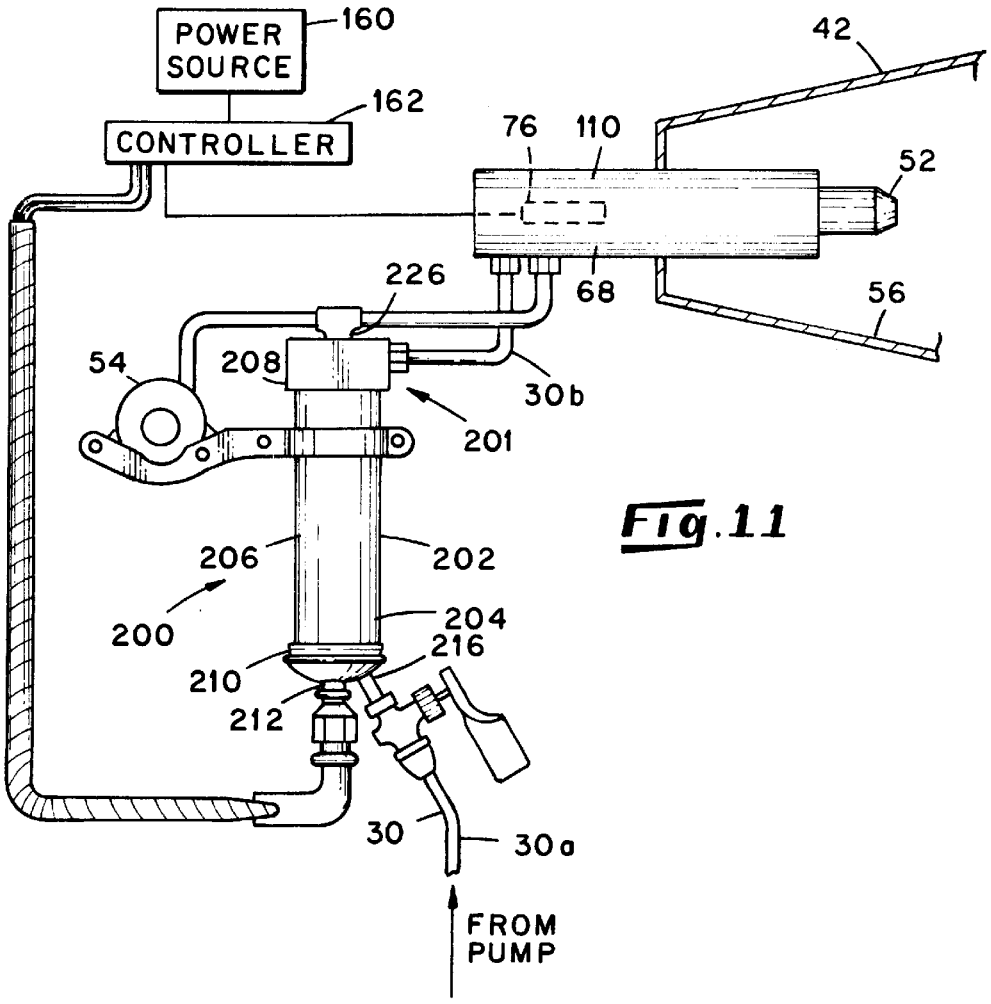
FIG. 11 is a fragmentary view illustrating a nozzle block and an oil-heating apparatus of an alternative design.

It will be understood that numerous modifications and substitutions can be had to the aforedescribed heating system without departing from the spirit of the invention. For example, there is illustrated in FIG. 11 an alternative embodiment, generally indicated 200, of an oil preheating system which utilizes an internal oil shut-off assembly 201 (FIG. 12) for positively shutting off the flow of oil to the nozzle block assembly 68 upon shutdown of furnace operation. The FIG. 11 system 200 employs many components which are identical to those of the system 18 of FIGS. 1–10, and accordingly, such components bear the same reference numerals.

As best shown in FIG. 11, the preheating system 200 includes an oil preheating unit 202 including a vertically-oriented canister 204 having a tubular shell 206 having its ends capped by upper and lower caps 208 and 210, respectively. A finned sheath 108 (FIG. 12) is positioned within the canister 204, and PTC heaters (not shown) are positioned within the sheath 108 in a manner similar to those of the unit 66 of FIGS. 1–10 except that the wires for the PTC heaters of the depicted unit 202 are directed out of the canister 204 through the lower end thereof. Accordingly, the lower cap 210 includes a nipple 212 through which the wires of the PTC heaters are directed, as well as a nipple 216 to which the oil fuel line 30 is connected.

Figure 12:
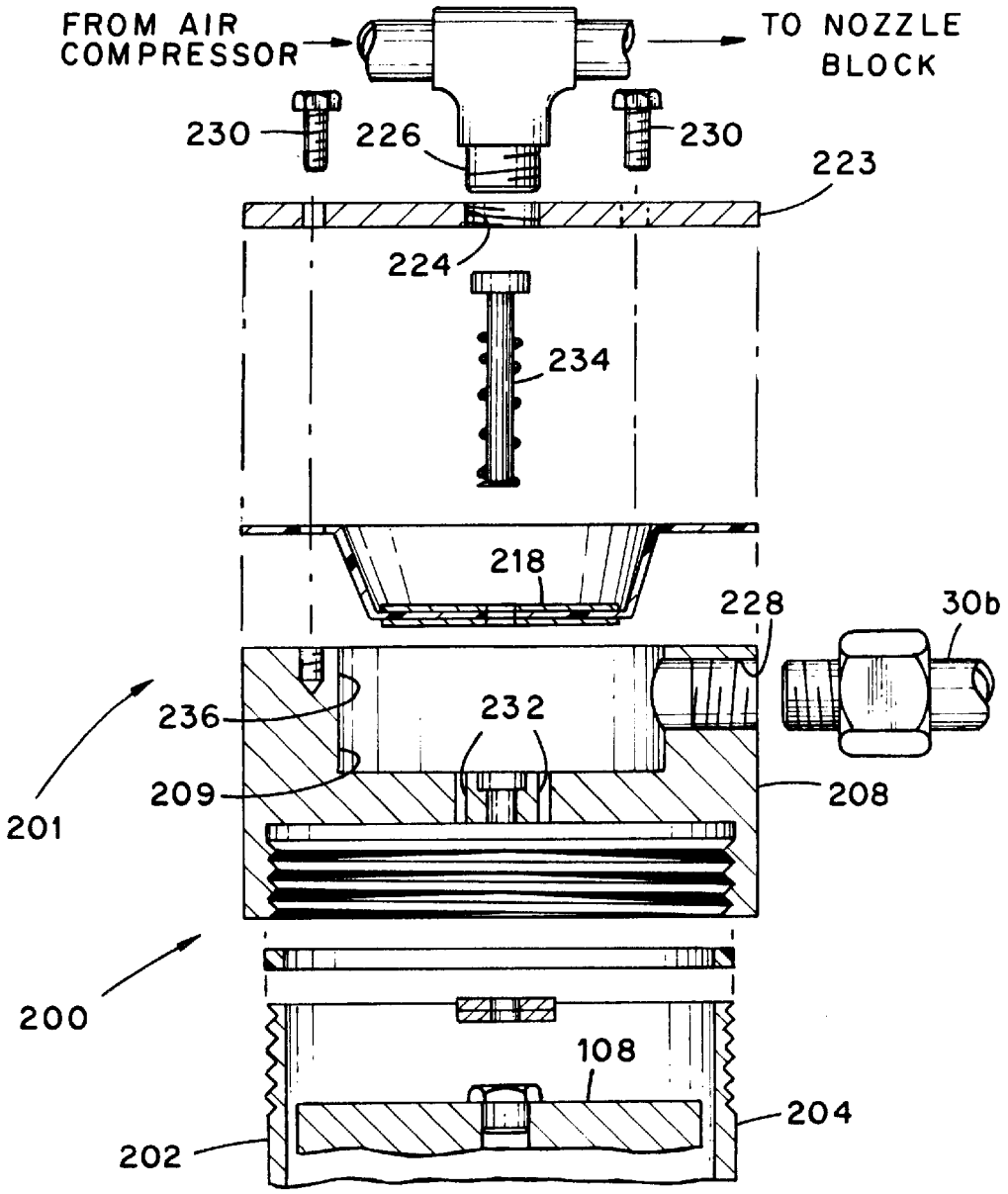
FIG. 12 is a fragmentary elevational view, shown partially in longitudinal section, of the oil-preheating apparatus of FIG. 11, shown exploded.
Figure 13:
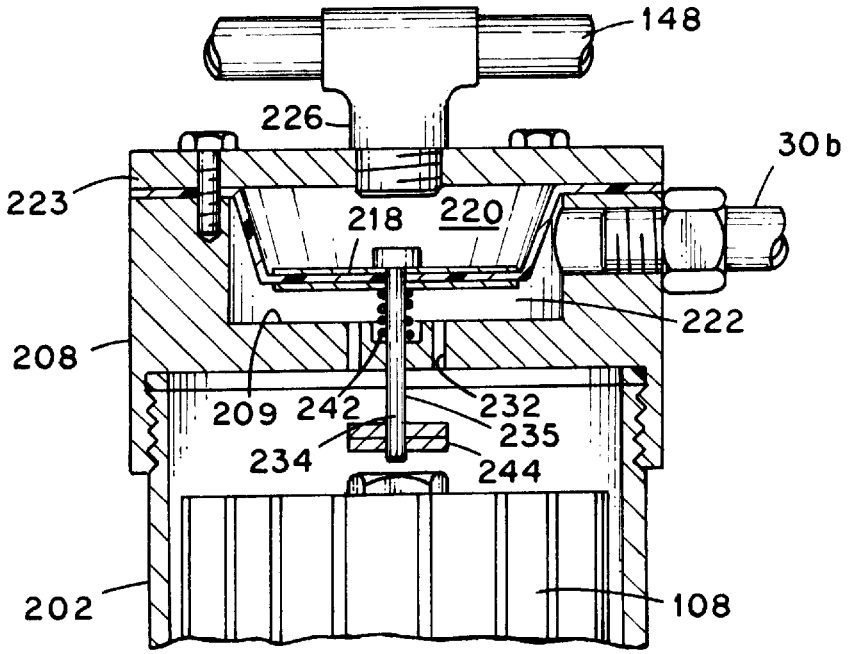
FIG. 13 is a view similar to that of FIG. 12 illustrating the components of the oil-preheating apparatus when in an assembled condition and with its diaphragm depicted in one position.
Figure 14:
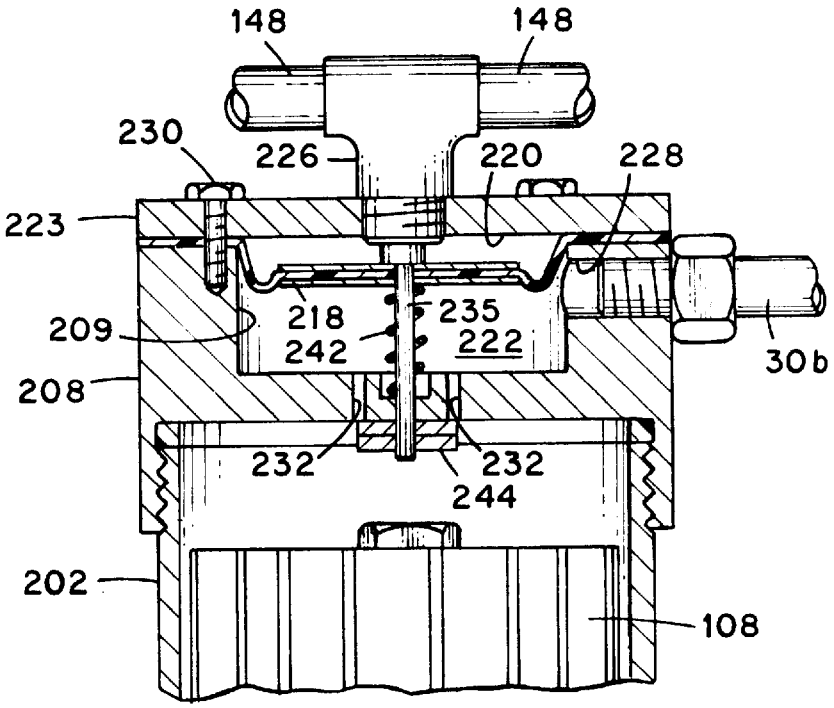
FIG. 14 is a view similar to that of FIG. 13 of the oil-preheating apparatus, shown with its diaphragm in another position.

With reference to FIGS. 12–14, the shutoff assembly 201 is mounted within the upper cap 208 of the canister 204 and includes an elastomeric diaphragm 218 which separates the interior, designated 209, of the upper cap 208 into an upper air-containing compartment 220 and a lower oil-containing compartment 222. The upper cap 208 includes an upper plate 223 having an opening 224 to which a branch line 226 leading from the air conduit 148 is connected so that the air-containing compartment 220 of the cap interior 209 is exposed, during furnace operation, to the air which exits the air compressor 54 (FIG. 11) under pressure. In addition, the upper cap 208 is formed with a passageway 228 through which the oil is moved from the canister 204 toward the nozzle block assembly 68 by way of the fuel line portion 30*b*. As will be apparent herein, the body of the cap 208 includes a plurality of bores 232 (only two shown in FIG. 12) through which the interior of the canister 204 is permitted to communicate with the oil passageway 228, and a plug assembly 234 is joined to the diaphragm 218 for opening and shutting off the bores 232 in conjunction with the (vertical) movement of the diaphragm 218, as is described herein.

The interior of the cap 208 is provided by a recess 236 formed within the body of the cap 208, and the diaphragm 218 has edge portions which are secured between the upper plate 223 and the (lower) body of the cap 208 with bolts 230. The diaphragm 218 also includes a central portion which is adapted to move upwardly and downwardly within the cap interior 209 (and thereby expand and contract) to alter the size of the upper compartment 220 by a corresponding amount. During furnace operation, the diaphragm 218 moves downwardly to an expanded condition, as illustrated in FIG. 12, by the pressure of the air exiting the compressor 54, while the diaphragm 218 is continually spring-biased upwardly toward a contracted condition, as illustrated in FIG. 14, by means of a compression spring 242 so that upon furnace shutdown (and cessation of compressor operation), the diaphragm 218 is automatically moved to its raised condition. To this end, the compression spring 242 is interposed between the base of the cap interior 209 and the underside of the diaphragm 218. The plug assembly 234 includes a headed shank 235 having a head which is fixedly secured through the center of the diaphragm 218 and a shutoff plug 244 which is affixed to the opposite end of the shank 235 and disposed beneath the bores 232 provided in the cap 208. When the internal pressure of the air within the upper compartment 220 drops to atmospheric (as is the case when the compressor 54 is turned OFF), the spring 242 is permitted to move the diaphragm 218 to raised condition and moves the plug 244 across so as to cover, and thereby close, the openings of the bores 232.

It follows from the foregoing that the upward and downward movement of the central portion of the diaphragm 218 is coordinated with the operation of the furnace air compressor 54 which, during furnace operation, is adapted to raise the pressure of the air within the air line 148 and the upper compartment 220 to a pressure level sufficient to lower the diaphragm 218 to the FIG. 13 expanded condition against the biasing force of the spring 242. When power to the air compressor 54 is shut off, as would occur upon furnace shutdown, the air pressure within the air line 148 and the upper compartment 220 falls to atmospheric so that the spring 242 raises the diaphragm 218 to the FIG. 14 contracted condition and moves the shutoff plug 244 into a relationship across the bores 232 of the cap 208 so that no oil is permitted to flow into or out of the lower compartment 222 of the cap interior 209.

An advantage provided by the aforedescribed shutoff system 201 relates to the upward and downward movements of the diaphragm 218 upon furnace shutdown and furnace start-up. In particular, upon furnace shutdown, the upward movement of the diaphragm 218 from the FIG. 13 condition to the FIG. 14 condition increases the oil-containing capacity of the canister 204 and thereby withdraws oil rearwardly through the fuel line portion 30*b* from the nozzle block assembly 68. This withdrawing of the oil away from the nozzle 52 of the nozzle block assembly 68 following shutdown removes much of the oil from the fuel line of the nozzle block assembly in a purging action so that there remains little oil within the nozzle block which could drip from the nozzle 52 or could carbonize or build up within the fuel passageway of the nozzle block. Along these lines, with little oil remaining within the nozzle block following furnace shutdown, any need for a PTC unit within the nozzle block is obviated.

By comparison, upon furnace start-up, the downward movement of the diaphragm 218 from the FIG. 14 condition to the FIG. 13 condition decreases the oil-containing capacity of the canister 204 and thereby pushes oil forwardly through the fuel line portion 30*b* and through the nozzle block assembly 68. This pushing of the oil along the fuel line upon start-up of the furnace provides a sudden delivery of oil to the combustion zone 56 in a manner which helps clear the nozzle block fuel line and initiate fuel combustion within the combustion zone 56 of the furnace. It has been found that the diaphragm 218 will operate (i.e. is capable of moving upwardly and downwardly between its limits of travel) when the oil pressure on the lower compartment-side thereof is within the (relatively broad) range of 0–50 psi because of the relatively small surface area on the oil-side of the diaphragm 218 against which the oil can act and because the diaphragm 218 creates no frictional forces which could otherwise hamper its movement.

It follows that the preheating unit 200 integrates an oil preheating system with a means for evacuating the nozzle block of oil between cycles of furnace operation. Moreover, the unit 200 is modular in form in that it can be mounted upstream of the nozzle block for performing its intended functions (i.e. preheating and purging) without the need of associating additional means, such as heating elements and solenoids, with the nozzle block in order that comparable functions are performed thereby. Accordingly, the preheating unit 200 permits the use of a less-complicated, lower cost nozzle block and is further advantageous in this respect.

Still another advantage of the aforedescribed preheating units 18 and 200 relates to the capacity of the units to be mounted in relatively close proximity to the nozzle block, thereby reducing the distance, and hence the oil temperature loss, that the heated oil must travel as its is moved from the unit to the nozzle. Furthermore, the preheating units obviate the need for a preheater having a capacity of high watts per square inch which may otherwise be required to maintain oil at a desirably high temperature, thereby permitting the system design to incorporate an uncomplicated and less-expensive nozzle line assembly.

Accordingly, the aforedescribed embodiments are intended for the purpose of illustration and not as limitation.

We claim:

1. In a fuel preheating system for an oil-burning furnace having a combustion zone within which oil is burned in the presence of air, a nozzle block assembly including an atomizing nozzle through which oil is routed into the combustion zone for burning, and a fuel line connected to the nozzle block assembly and providing a passageway disposed upstream of the nozzle block assembly through which oil is routed to the combustion zone for burning, the improvement comprising:

a body disposed upstream of the nozzle block assembly and providing a section of the oil passageway through which oil is routed to the combustion zone;

an electrically-powered positive temperature coefficient (PTC) heating element for receiving electrical power from a source wherein the PTC heating element is mounted within the section of the oil passageway disposed upstream of the nozzle block assembly and in heat transfer relationship with oil contained within the oil passageway section for heating the oil contained within the oil passageway section to about a preselected temperature, and a heat-conductive sheath positioned about the PTC element and mounted within the body so that the oil contained within the oil passageway section is physically separated from the PTC element by the heat-conductive sheath and so that heat transmitted from the PTC element is conducted to the oil contained within the passageway section through the heat-conductive sheath, the sheath including an elongated body having two opposite ends, a central opening within which the PTC element is positioned and a plurality of fins which extend linearly along the elongated body of the sheath and having outer surfaces which are in contact with the oil contained within the oil passageway section.

2. The improvement as defined in claim 1 wherein the PTC element is a first PTC element and the improvement further comprises a second PTC element mounted within the central opening of the elongated body of the sheath and in heat transfer relationship with oil contained with the oil passageway disposed upstream of the nozzle block assembly for heating the oil which flows therethrough to an elevated temperature.

3. The improvement as defined in claim 2, including means for energizing the first PTC element prior to a cycle of furnace operation, and means for energizing the second PTC element during a cycle of furnace operation.

4. The improvement as defined in claim 1 further comprising a thermostat mounted in heat transfer relationship with oil contained within the oil passageway disposed upstream of the nozzle block assembly, and the thermostat is adapted to prevent the initiation of a cycle of furnace operation until the temperature of said oil passageway is elevated to a predetermined temperature.

5. The improvement as defined in claim 1 wherein the oil-burning furnace includes an air passageway through which air is routed toward the combustion zone, means for moving the air through the air passageway in a pressurized condition, and the improvement further comprises shutoff means associated with the fuel passageway disposed upstream of the nozzle block assembly and responsive to the internal pressure of the air passageway for shutting off the flow of oil along the fuel line upon shutdown of furnace operation.

6. The improvement as defined in claim 5 wherein the shutoff means includes a movable element having a portion adapted to move between two conditions relative to the fuel line in conjunction with the raising of the internal pressure of the air passageway upon start-up of the furnace and the lowering of the internal pressure of the air passageway upon shutdown of the furnace.

7. The improvement as defined in claim 6 wherein the shutoff means is adapted to purge oil from at least a portion of the nozzle block assembly upon movement of the movable portion of the movable element during shutdown of the furnace.

8. The improvement as defined in claim 7 further comprising:

a modular body which provides at least a section of the oil passageway disposed upstream of the nozzle block assembly and wherein the PTC heating element is mounted within the modular body and in heat transfer relationship with oil contained within the oil passageway disposed upstream of the nozzle block assembly, and the movable portion of the movable element of the shutoff means is mounted with the modular body so that movement of the movable portion during shutdown of the furnace effects a withdrawl of oil from the nozzle block assembly.

9. A preheating system for use in a liquid fuel-burning furnace including a combustion zone, a nozzle block assembly including an atomizing nozzle through which fuel is routed toward the combustion zone for burning in the presence of air, and a fuel line joined to and disposed upstream of the nozzle block assembly through which fuel is routed toward the nozzle block assembly, the system comprising:

a body disposed upstream of the nozzle block assembly and providing a fuel passageway section associated with the fuel line through which the fuel is conducted as it is routed toward the nozzle block assembly, and a positive temperature coefficient (PTC) electric heating element adapted to receive power from a source and associated with the body of the preheating system for preheating the fuel contained within the passageway section of the body so that the fuel is in a preheated condition prior to its introduction into the nozzle block assembly;

a heat-conductive sheath associated with the fuel passage section-providing body and positioned about the PTC element so that the fuel contained within the passageway section is physically separated from the PTC element by the heat-conductive sheath and so that heat transmitted from the PTC element is conducted through the heat-conductive member to the fuel contained within the passageway section through the heat-conductive sheath, the sheath including an elongated body having two opposite ends, a plurality of fins which extend linearly along the elongated body of the sheath and having outer surfaces which are in contact with the fuel contained within the fuel passageway section so that the fuel which flows through the fuel passageway section flows therethrough from one end of the elongated body to the other end of the elongated body and along the length of the fins.

10. The preheating system as defined in claim 9 wherein the elongated body is positionable in a vertical orientation so that fuel which is moved through the fuel passageway-providing body from one end of the fuel passageway-providing body to the other end of the fuel passageway-providing body is directed along a substantially upward path.

11. The preheating system as defined in claim 9 wherein the PTC element is a first PTC element, the elongated body of the sheath includes a central opening within which the first PTC element is mounted, and the preheating system further includes a second PTC element mounted within the central opening of the elongated body of the sheath and in heat transfer relationship with fuel contained within the fuel passageway section for heating the fuel which flows therethrough to an elevated temperature.

12. The preheating system as defined in claim 11 including means for energizing the first PTC element prior to a cycle of furnace operation, and means for energizing the second PTC element during a cycle of furnace operation.

13. The preheating system as defined in claim 11 wherein each of the first and second PTC elements are in the form of an elongated pellet and the first and second PTC elements are closely fitted within the central opening of the elongated body of the sheath and are arranged within the central opening in an end-to-end relationship.

14. The preheating system as defined in claim 13 wherein the first and second PTC elements are adapted to receive electrical power by way of power wires which extend from each of the first and second PTC elements and out of the elongated body of the sheath through a single end thereof.

15. The preheating system as defined in claim 9 further comprising a thermostat mounted in heat transfer relationship with fuel contained within the fuel passageway section, and the thermostat is adapted to prevent the initiation of a cycle of furnace operation until the temperature of the fuel passageway section is elevated to a predetermined temperature.

16. In a liquid fuel-burning furnace including a combustion zone, a fuel line through which fuel is routed toward the combustion zone for burning in the presence of air and a nozzle block assembly including a nozzle associated with the fuel line through which the fuel is conducted from the fuel line into the combustion zone in an atomized condition, the improvement comprising:

a preheating system for preheating the fuel prior to its introduction into the combustion zone by way of the nozzle, the preheating system including a) a body providing a fuel passageway section connected in-line with the fuel line so that as the fuel is routed through the fuel line toward the nozzle, the fuel flows through the fuel passageway section, the fuel passageway section-providing body being disposed upstream of the nozzle block assembly so as to be a separately-identifiable component from that of the nozzle block assembly, and b) a positive temperature coefficient (PTC) electric heating element adapted to receive power from a source and associated with the fuel passageway section-providing body of the preheating system for preheating the fuel contained within the fuel passageway section of the fuel passageway section-providing body; and c) a heat-conductive sheath positioned about the PTC element and mounted within the fuel passageway section-providing body and within which the PTC element is mounted so that fuel which flows through the fuel passageway section is separated from the PTC element by the heat-conductive sheath so that heat transmitted from the PTC element is conducted through the heat-conductive sheath to the fuel contained within the passageway section, the sheath including an elongated body having two opposite ends, a central opening within which the PTC element is positioned and a plurality of fins extending radially of the elongated body and linearly therealong, and the sheath is disposed within the fuel passageway-providing means so that fuel which flows through the fuel passageway toward the nozzle flows from one end of the elongated body toward the opposite end of the elongated body and flows in contact with and along the length of the fins.

17. The improvement as defined in claim 16 further comprising a thermostat mounted in heat transfer relationship with fuel contained within the fuel passageway section, and the thermostat is adapted to prevent the initiation of a cycle of furnace operation until the temperature of the fuel passageway section is elevated to a predetermined temperature.

18. In an oil-burning furnace including a combustion zone, a fuel line, and a nozzle block assembly having a nozzle through which air is conducted into the combustion zone and a fuel passageway through which oil is conducted from the fuel line into the combustion zone for burning in the presence of air, an air passageway through which air is routed to the nozzle, and means for moving the air through the air passageway in a pressurized condition, and wherein the internal pressure of the air passageway drops to atmospheric pressure upon furnace shutdown and wherein the fuel line is connected to the fuel passageway of the nozzle block assembly for delivery of oil thereto during furnace operation, the improvement comprising:

shutoff means associated with the fuel line and responsive to the internal pressure of the air passageway for shutting off the flow of oil along the fuel line upon shutdown of furnace operation and wherein the shutoff means is adapted to withdraw oil rearwardly along the fuel passageway from the nozzle and thereby purge the fuel passageway of the nozzle block assembly of oil in conjunction with the lowering of the internal pressure of the air passageway to atmospheric pressure upon furnace shutdown.

19. The improvement as defined in claim 18 wherein the shutoff means includes a movable element having a portion adapted to move between two conditions relative to the fuel line in conjunction with the lowering of the internal pressure of the air passageway to atmospheric upon shutdown of the furnace, and the withdrawal of oil rearwardly along the fuel passageway from the nozzle as well as the purging of the fuel passageway of oil is effected by the movement of the movable element between the two conditions upon furnace shutdown.

20. The improvement as defined in claim 19 further comprising a modular body having an interior which is connected in-line with the fuel line and into which oil of the fuel line is routed prior to its introduction into the nozzle block assembly;

the movable portion of the movable element of the shutoff means is mounted with the modular body so that movement of the movable portion during shutdown of the furnace as aforesaid effects the withdrawal of oil rearwardly along the fuel passageway from the nozzle and the resulting purging of oil from the nozzle block assembly; and a positive temperature coefficient (PTC) electric heating element adapted to receive power from a source and mounted within the interior of the modular body for preheating the oil contained within the interior of the modular body so that oil is in a preheated condition prior to its introduction into the nozzle block assembly from the modular body.

* * * * *

UNITED STATES PATENT AND TRADEMARK OFFICE

CERTIFICATE OF CORRECTION

PATENT NO. : 5,879,149

DATED : March 9, 1999

INVENTOR(S) : Eugene C. Briggs et al

It is certified that error appears in the above-indentified patent and that said Letters Patent is hereby corrected as shown below:

The text which begins with the paragraph starting with the phrase "Still another" at col. 3, line 1, and ends with the phrase "PTC elements" at col. 3, line 36 should not appear where it is printed, but instead should appear between the phrases "prior art." and "draws power" at col. 1, line 64.

Signed and Sealed this

Thirteenth Day of July, 1999

*Attest:*

*Attesting Officer*

Q. TODD DICKINSON

*Acting Commissioner of Patents and Trademarks*